United States Patent [19]

Acker et al.

[11] 4,367,866

[45] Jan. 11, 1983

[54] FURNACE ADAPTED TO CONTAIN MOLTEN METAL

[75] Inventors: John N. Acker, Ringwood; Robert A. Petersen, Elgin, both of Ill.

[73] Assignee: Sunbeam Equipment Corporation, Meadville, Pa.

[21] Appl. No.: 252,971

[22] Filed: Apr. 10, 1981

[51] Int. Cl.[3] ..... F27D 1/16; F27B 14/00

[52] U.S. Cl. ..... 266/99; 266/275; 266/281; 266/283; 266/286

[58] Field of Search ..... 266/280, 281, 283, 286, 266/99, 275, 171; 75/68 R; 65/345

[56] References Cited

U.S. PATENT DOCUMENTS

| | | | |
|---|---|---|---|
| 1,615,842 | 2/1927 | Hitner | 65/345 |
| 1,857,103 | 5/1932 | South . | |
| 1,871,159 | 8/1932 | Davis et al. . | |
| 1,883,590 | 10/1932 | Crosby et al. . | |
| 2,221,620 | 11/1940 | Wagstaff | 266/171 X |
| 2,473,611 | 6/1949 | Robson | 266/171 X |
| 2,491,579 | 12/1949 | Poland | 13/25 |
| 2,571,033 | 10/1951 | Harter, Jr. et al. | 22/79 |
| 2,659,120 | 11/1953 | Harter, Jr. et al. | 22/79 |
| 3,211,443 | 10/1965 | Starner et al. | 266/39 |
| 3,225,398 | 12/1965 | Davey et al. | 22/84 |
| 3,240,590 | 3/1966 | Schmide et al. | 75/68 R |
| 3,261,627 | 7/1966 | Plumat | 65/345 |
| 3,345,059 | 10/1967 | Swindt | 266/39 |
| 3,412,195 | 11/1968 | Mumper | 13/27 |
| 3,689,051 | 9/1972 | Miller | 266/280 X |
| 3,830,173 | 8/1974 | Hubble et al. | 106/313 X |
| 3,898,366 | 8/1975 | Aurini | 3/35 |
| 3,996,412 | 12/1976 | Schaefer et al. | 13/20 |
| 4,011,394 | 3/1977 | Shelley | 13/20 |
| 4,012,029 | 3/1977 | Seguin et al. | 266/275 |
| 4,019,888 | 4/1977 | Verhappen et al. | 65/345 X |
| 4,027,862 | 6/1977 | Schaefer et al. | 266/160 |
| 4,160,796 | 7/1979 | Lirones | 264/60 |
| 4,194,730 | 3/1980 | Matsumoto | 266/280 X |
| 4,201,882 | 5/1980 | Kolotilo et al. | 13/27 |
| 4,208,043 | 6/1980 | Sieurin | 266/275 |
| 4,222,337 | 9/1980 | Christiansen | 110/336 |
| 4,222,338 | 9/1980 | Adams | 110/336 |

FOREIGN PATENT DOCUMENTS

| | | | |
|---|---|---|---|
| 830244 | 2/1952 | Fed. Rep. of Germany . | |
| 1191933 | 4/1965 | Fed. Rep. of Germany . | |
| 1220085 | 6/1966 | Fed. Rep. of Germany . | |
| 1208451 | 7/1966 | Fed. Rep. of Germany . | |
| 2163533 | 7/1972 | Fed. Rep. of Germany . | |
| 1807001 | 12/1976 | Fed. Rep. of Germany . | |
| 2612912 | 9/1977 | Fed. Rep. of Germany . | |
| 132000 | 8/1978 | Fed. Rep. of Germany | 266/99 |
| 2316025 | 3/1977 | France | 266/280 |
| 2355595 | 2/1978 | France | 266/281 |
| 106746 | 3/1943 | Sweden . | |
| 106747 | 3/1943 | Sweden . | |
| 210134 | 1/1967 | Sweden . | |
| 320768 | 2/1970 | Sweden . | |
| 324863 | 6/1970 | Sweden . | |
| 350333 | 10/1972 | Sweden . | |
| 1167463 | 10/1969 | United Kingdom . | |
| 290919 | 8/1971 | U.S.S.R. . | |
| 358602 | 12/1972 | U.S.S.R. . | |
| 405008 | 4/1974 | U.S.S.R. . | |

*Primary Examiner*—L. Dewayne Rutledge
*Assistant Examiner*—David A. Hey
*Attorney, Agent, or Firm*—George R. Clark; Neil M. Rose; Clifford A. Dean

[57] ABSTRACT

A furnace to contain molten zinc, molten aluminum, or other molten metal has an outer vessel, an inner vessel, and particulate matter packed therebetween so as to enable the inner vessel to be lifted readily from the outer vessel. Electrical conductors are imbedded in said matter and arranged to close an electrical circuit including a signalling means if bridged by any molten metal leaking from the inner vessel. The furnace is provided with a removable bonnet, a beam mounted across the inner vessel, and a partition mounted to and beneath the beam so as to extend into the molten metal deeply. The inner and outer vessels, the removable bonnet, and the beam are insulative. The partition is a good conductor of heat.

5 Claims, 4 Drawing Figures

FURNACE ADAPTED TO CONTAIN MOLTEN METAL

BACKGROUND OF THE INVENTION

This invention pertains to a furnace, which is adapted to contain molten zinc, molten aluminum, or other molten metal, and which thus is useful in die-casting facilities. The furnace may be a melting or holding furnace.

As exemplified in U.S. Pat. No. 3,996,412 and U.S. Pat. No. 4,027,862, it is known for a furnace of similar utility to comprise a vessel, which is adapted to contain such molten metal, and which is lined with a refractory material. The refractory material may be cast, compacted, or comprised of refractory bricks set in a suitable mortar. In any event, it is necessary for the furnace to be relined from time to time, and it is difficult, expensive, and time-consuming job to reline the furnace.

As exemplified in U.S. Pat. No. 4,208,043, it is known for a vessel for such molten metal to be constructed of rigid ceramic plates, which have complementary joints, which have felted ceramic inserts sealing the joints, and which are assembled with screw fasteners. The innermost plates, which contain such molten metal, cannot be removed readily. U.S. Pat. No. 4,222,337 and U.S. Pat. No. 4,222,338 exemplify prior art of related interest.

As exemplified in German Auslegeschrift No. 1,807,001, it is known for a crucible for molten metal to comprise an outer vessel and an inner vessel and for an intermediate layer of glass wool, mineral wool, or other fibrous material to be provided between the lateral walls of the outer and inner vessels.

As exemplified in U.S. Pat. No. 3,345,059, it is known for a crucible for molten metal to comprise an outer vessel, which has double insulative shells, and an inner vessel, which is positioned snugly within the inner shell of the outer vessel, for an "expansion" layer to be provided between the lateral walls of the inner and outer shells of the outer vessel, for an intermediate layer of granular material, which may be alumina powder, to be provided between the bottom walls of the inner and outer shells of the outer vessel, and for similar material to be packed between the outer vessel and a metal box, which encloses the outer vessel. It is disclosed that the "expansion" layer is "preferably aluminum-silicate fibers, refractory pebbles or crushable shapes."

As exemplified in U.S. Pat. No. 4,012,029, it is known for a tundish for molten metal to have an intermediate layer of particulate material between its permanent outer and expendable inner linings.

As exemplified in U.S. Pat. No. 3,898,366, it is known in a vessel for molten metal for electrical conductors to be imbedded in a refractory wall of the vessel, and for the conductors to close an electrical circuit so as to actuate an indicating means when the refractory wall has worn sufficiently to expose the conductors to the molten metal.

SUMMARY OF THE INVENTION

This invention provides in a furnace, which is adapted to contain molten zinc, molten aluminum, or other molten metal, a combination comprising an outer vessel, which has lateral and bottom walls, an inner vessel, which is adapted to contain the molten metal, which has lateral and bottom walls, and which is fitted into the outer vessel so as to leave sufficient clearance around the inner vessel, between the lateral walls of the inner and outer vessels, for particulate matter to be packed around the inner vessel, between the lateral walls of the inner and outer vessels, and a mass of particulate matter, which is packed around the inner vessel, between the lateral walls of the inner and outer vessels, so as to lodge the inner vessel laterally within the outer vessel despite nonconformities between the lateral walls of the inner and outer vessels, and so as to enable the inner vessel to be lifted readily from the outer vessel. Said matter may be sand, vermiculite, or equivalent.

Additionally, the combination comprises a layer of said matter, which is packed on the bottom wall of the outer vessel, between the bottom walls of the inner and outer vessels, so as to support the inner vessel and its contents firmly despite nonconformities between the bottom walls of the inner and outer vessels.

Additionally, the combination comprises an electrical circuit including electrical conductors, which are imbedded within said layer of said matter, whereupon said matter is packed so as to be pervious to the molten metal, and whereupon the conductors are arranged to close the electrical circuit if any of the molten metal leaks from the inner vessel, perfuses said matter, and bridges the conductors. The electrical circuit also may include a signalling means, which is arranged to emit a signal if the electrical circuit is closed.

Preferably, the inner vessel is seamless. The inner vessel may be a vacuum-formed, ceramic-fiber, one-piece vessel.

In its preferred form, the furnace provides an inner vessel, which is not prone to leakage of the molten metal from the inner vessel, which may be removed readily from the outer vessel for inspection, replacement, or repair of the inner vessel, and which also may be replaced readily.

Also, the signalling means emits a signal if any of the molten metal bridges the conductors so as to inform a user that some of the molten metal may have leaked from the inner vessel, which thus may need to be inspected, replaced or repaired.

Advantageously, the inner and outer vessels may be made of insulative materials that are poor conductors of heat, whereupon the furnace may be provided with a removable bonnet, which covers the inner and outer vessels except for a filling and emptying zone, and which is made of an insulative material that is a poor conductor of heat, a beam, which is mounted across the inner vessel, and which is made of an insulative material that is a poor conductor of heat, and a partition, which is mounted to and beneath the beam so as to extend into the molten metal deeply but so as to permit the molten metal to flow freely beneath the partition, and which is made of a material that is a good conductor of heat. The removable bonnet, the inner vessel, and the beam may be made of the same material.

Herein, all references to "poor" and "good" conductors of heat are used comparatively, as a person skilled in the art is familiar with materials that are poor conductors of heat and with materials that are good conductors of heat.

These and other objects, features, and advantages of this invention are evident from the following description of a preferred embodiment of this invention.

BRIEF DESCRIPTION OF THE DRAWINGS

FIG. 2 shows a removable bonnet, which has been omitted in FIG. 1.

DETAILED DESCRIPTION OF PREFERRED EMBODIMENT

Figure 1:
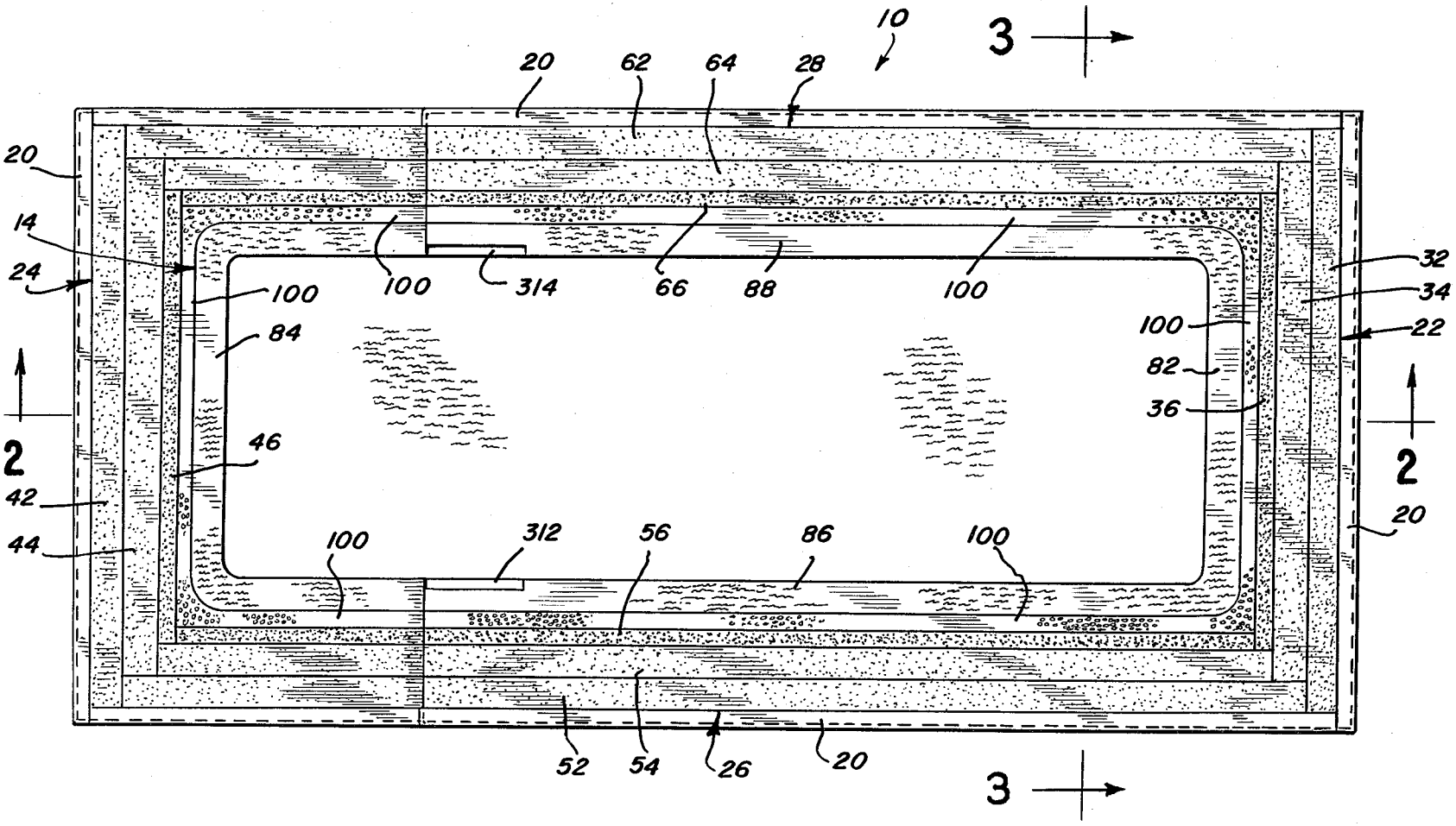
FIG. 1 is a top, plan view of a furnace embodying this invention.

As shown in the drawings, a furnace 10 embodying this invention in its preferred form is adapted to contain molten zinc, molten aluminum, or other molten metal. The furnace 10, which thus is useful in die-casting facilities, may be a melting or holding furnace. Its utility as a melting or holding furnace depends primarily upon its heating capacity, which is not crucial to this invention.

Figure 3:
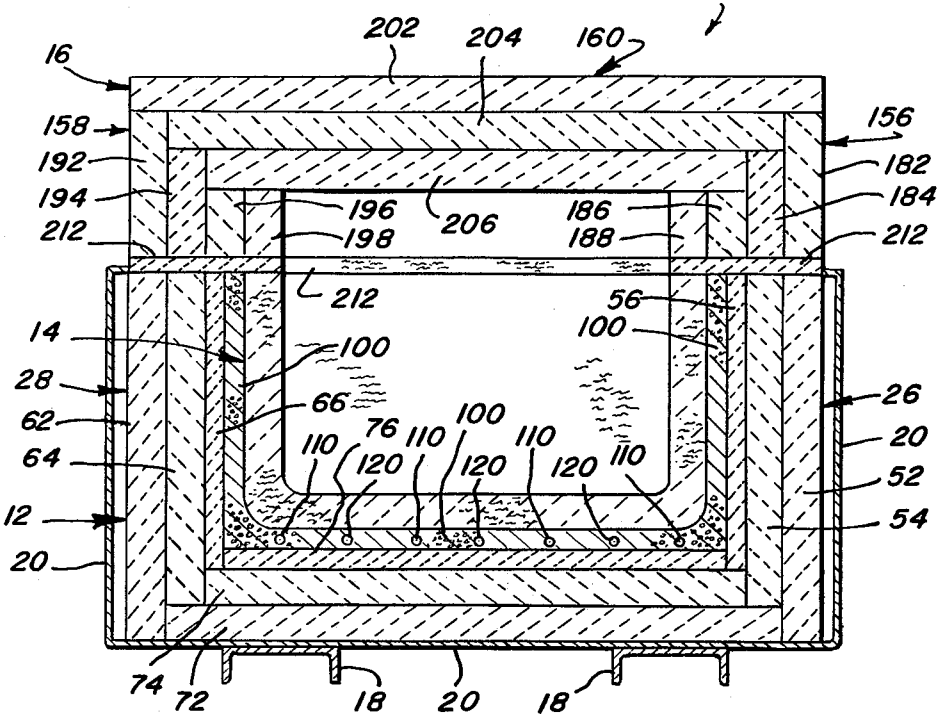
FIG. 3 is a sectional view of the furnace, as taken along line 3—3 of FIG. 1 in a direction indicated by arrows.

Generally, the furnace 10 comprises an outer vessel 12, an inner vessel 14, and a removable bonnet 16. As shown in FIGS. 1 and 3, the furnace 10 rests on a pair of steel rails 18. The rails 18 may be oriented as shown or inverted.

The outer vessel 12, which is enclosed on its sides and its bottom by a steel shell 20, has opposite end walls 22, 24, opposite side walls 26, 28, and a bottom wall 30. Herein, the end walls 22, 24, and the side walls 26, 28, are considered to be the lateral walls of the outer vessel 12. The end wall 22 is a composite comprising an outer plate 32, an intermediate plate 34, and an inner plate 36. The end wall 24 is a composite comprising an outer plate 42, an intermediate plate 44, and an inner plate 46. The side wall 26 is a composite comprising an outer plate 52, an intermediate plate 54, and an inner plate 56. The side wall 28 is a composite comprising an outer plate 62, an intermediate plate 64, and an inner plate 66. The bottom wall 30 is a composite comprising a lower plate 72, an intermediate plate 74, and an upper plate 76.

As shown, the lower plate 72 is fitted between the outer plates 32, 42, of the end walls 22, 24. Also, the intermediate plate 74 of the bottom wall 30 and the upper plate 76 of the bottom wall 28 fit between the intermediate plates 34, 44, of the end walls 22, 24. As shown, the lower plate 72 of the bottom wall 28 is fitted between the outer plates 52, 62, of the side walls 26, 28. Also, the intermediate plate 74 of the bottom wall 30 fits between the intermediate plates 54, 64, of the side walls 26, 28. Also, the upper plate 76 of the bottom wall 30 fits between the inner plates 56, 66, of the side walls 26, 28. Hence, a stepped arrangement of the adjoining surfaces of the respective plates of the outer vessel 12 is obtained. Suitable sealing material (not shown) may be applied to said adjoining surfaces. Suitable sealing material is available commercially as Super 3000 Mortar from C-E Refractories Division of Combustion Engineering, Inc., P.O. Box 828, Valley Forge, Pennsylvania 19482. The respective plates of the end and side walls of the outer vessel 12 may be assembled by threaded fasteners, which are not shown, although such fasteners are not necessary.

As shown, air spaces are provided between the end walls 22, 24, and the steel shell 20. As shown in FIG. 3, air spaces are provided between the side walls 26, 28, and the steel shell 20. However, the lower ends of the outer plates 32, 42, of the end walls 22, 24, the lower ends of the outer plates 52, 62, of the side walls 26, 28, and the lower plate 72 of the bottom wall 30 rest on the steel shell 20.

The outer plates 32, 42, of the end walls 22, 24, the intermediate plates 34, 44, of the end walls 22, 24, the outer plates 52, 62, of the side walls 26, 28, the intermediate plates 54, 64, of the side walls 26, 28, the lower plate 72 of the bottom wall 30, and the intermediate plate 74 of the bottom wall 30 are made from a refractory material, which has suitable insulative properties, and which has sufficient rigidity, but which does not need to be impervious to the molten metal. Suitable refractory material is available commercially as M Board from Babcock & Wilcox Co., 1010 Common Street, New Orleans, La. 70161.

The inner plates 36, 46, of the end walls 22, 24, the inner plates 56, 66, of the side walls 26, 28, and the upper plate 76 of the bottom wall 30 are made from a refractory material, which is impervious to the molten metal. Suitable refractory material is available commercially as CD Board from Refractory Products Co., P.O. Box 2134, 770 Tollgate Road, Elgin, Ill. 60120.

The inner vessel 14 has opposite end walls 82, 84, opposite side walls 86, 88, and a bottom wall 90. Herein, the end walls 82, 84, and the side walls 86, 88, are considered to be the lateral walls of the inner vessel 14.

The inner vessel 14, which is seamless, is a vacuum-formed, ceramic-fiber, one-piece vessel. The inner vessel 14 is made of a ceramic material that is impervious to the molten metal. Suitable ceramic material is available commercially as WRP-X Material (with HA Hardener) from Refractory Products Co., supra. However, some ceramic materials including WRP-X Material (with HA Hardener) may not be compatable with certain fluxes, which may be added to the molten metal, as it has been found that certain fluxes attack such ceramic material destructively.

A layer of particulate matter 100, which may be sand, vermiculite, or equivalent, is packed on the upper plate 76 of the bottom wall 30 of the outer vessel 12. The inner vessel 14 is fitted into the outer vessel 12 so as to rest on the layer of particulate matter 100, and so as to leave sufficient clearance around the inner vessel 14, between the lateral walls of the inner vessel 14 and the lateral walls of the outer vessel 12, for a mass of said matter, which is packed around the inner vessel 14, between the lateral walls of the inner vessel 14 and the lateral walls of the outer vessel 12, so as to lodge the inner vessel 14 laterally within the outer vessel 12 despite nonconformities between the lateral walls of the inner vessel 14 and the lateral walls of the outer vessel 12. The layer of particulate matter 100 is packed on the bottom wall 30 of the outer vessel 12, between the bottom wall 90 of the inner vessel 14 and the upper plate 76 of the bottom wall 30 of the outer vessel 12, so as to support the inner vessel 14 and its contents firmly despite nonconformities between the bottom wall 90 of the inner vessel 14 and the upper plate 76 of the bottom wall 30 of the outer vessel 12. Nonconformities therebetween can be expected because it is difficult to maintain precise dimensional controls in production of vacuum-formed, ceramic-fiber, one-piece vessels.

Figure 4:
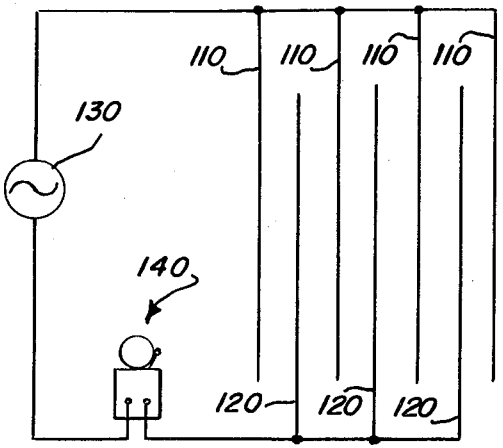
FIG. 4 is a diagram of an electrical circuit used in the furnace of FIG. 1.

As shown, a first set of electrical conductors 110 and a second set of electrical conductors 120 are imbedded in the layer of the particulate matter 100. As and where imbedded, the conductors 110, 120, may be bare wires, which are insulated electrically from each other by the layer of particulate matter 100. As shown in FIG. 4, the conductors 110, 120, are connected in an electrical circuit, which is diagrammed in FIG. 4, and which also comprises a source 130 of alternating current (24 VAC, 60 Hz, as an example) and a signalling means 140, which is shown to be a bell. A lamp, other signalling means, or a relay controlling electrical heating elements of the furnace 10 may be substituted for the bell. The electrical circuit is closed if any of the molten metal leaks from the inner vessel 14, perfuses the layer of particulate matter 100, and bridges the conductors 110, 120, whereupon the signalling means 140 emits a signal so as to inform a user that some of the molten metal may have leaked from the inner vessel 14, which thus may need to be inspected, replaced, or repaired.

The matter 100 packed around the inner vessel 14 enables the inner vessel 14 to be lifted readily from the outer vessel 12, after most of the molten metal has been ladled from the inner vessel 14, for inspection, replacement, or repair of the inner vessel 14. After the inner vessel 14 has been removed from the outer vessel 12, the matter 100 may be removed from the outer vessel 12 by means of an industrial vacuum cleaner, which is not shown, whereupon the layer of particulate matter 100 may be repacked, whereupon the inner vessel 14 (which may be a replacement for one that has been removed) may be lowered into the outer vessel 12 so as to rest on the layer, and whereupon the mass of particulate matter 100 around the inner vessel 14 may be repacked.

As shown, the removable bonnet 16 has opposite end walls 152, 154, opposite side walls 156, 158, and a top wall 160. The end wall 152 is a composite comprising an outer plate 162, adjacent intermediate plates 164, 166, and an inner plate 168. The end wall 154 is a composite comprising an outer plate 172, an intermediate plate 174, and an inner plate 176. The side wall 156 is a composite comprising an outer plate 182, adjacent intermediate plates 184, 186, and an inner plate 188. The side wall 158 is a composite comprising an outer plate 192, adjacent intermediate plates 194, 196, and an inner plate 198. The top wall 160 is a composite comprising an upper plate 202, an intermediate plate 204, and a lower plate 206. The respective plates of the end and side walls of the removable bonnet 16 are assembled by threaded fasteners, which are not shown, and are made of the same material used for the intermediate and outer plates of the outer vessel 12.

Figure 2:
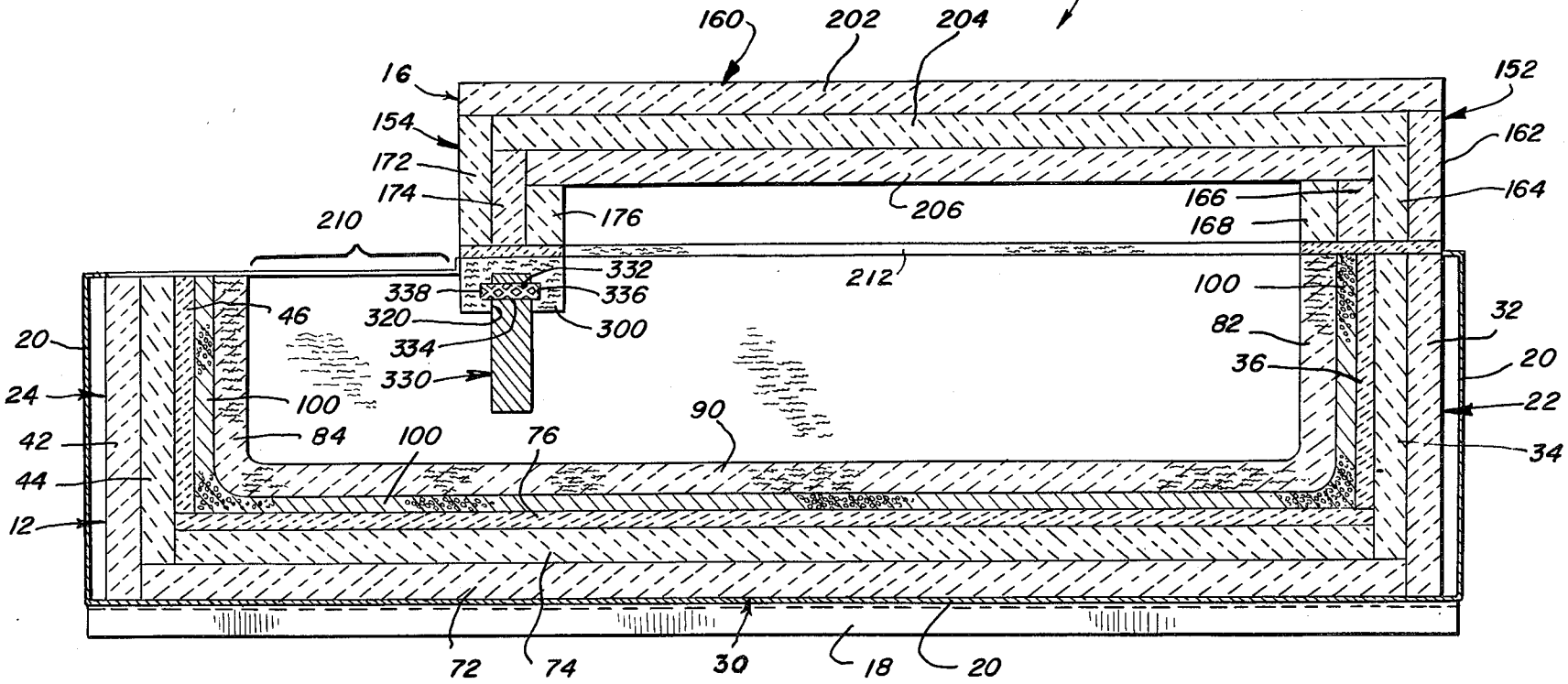
FIG. 2 is a sectional view of the furnace, as taken section along line 2—2 of FIG. 1 in a direction indicated by arrows.

As measured longitudinally, the side walls 156, 158, and the top wall 160 of the removable bonnet 16 are shorter than the side walls of the outer and inner vessels, as shown in FIGS. 1 and 2, so as to leave an uncovered zone 210, which may be used for filling, emptying, or both, and in which the inner vessel 14 remains uncovered, when the removable bonnet 16 is installed over the outer and inner vessels. When the furnace 10 is not operating, the uncovered zone 210 may be covered by a suitable cover, which is not shown. When the removable bonnet 16 is installed over the outer and inner vessels, an insulating gasket 212, which is not shown in FIG. 1, is inserted wherever the lower edges of the removable bonnet 16 are to be supported by the upper edges of the outer and inner vessels, the lower edges of the side walls of the removable bonnet 16 are supported by the upper edges of the side walls of the inner and outer vessels, and the lower edge of the end wall 152 of the removable bonnet 16 is supported by the upper edge of the end wall 22 of the outer vessel 12 and by the upper edge of the end wall 82 of the inner vessel 14. The lower edge of the end wall 154 of the removable bonnet 16 bridges the inner vessel 14 and is supported in a manner described hereinafter.

As measured vertically, the end wall 24 of the outer vessel 12 and the end wall 84 of the inner vessel 14 are shorter than the end wall 22 of the outer vessel 12 and the end wall 82 of the outer vessel 14, and the side walls of the outer and inner vessels are shorter as well, as far as the filling and emptying zone 210 extends from the end wall 24 of the outer vessel 12 and the end wall 84 of the inner vessel 14, so as to entail that the inner vessel 14 cannot be filled with the molten metal to such depth that the molten metal could reach the insulating gasket 212, the removable bonnet 16, or both, as excess molten metal would spill from the uncovered zone 210. It is easy for a user of the furnace 10 to observe the uncovered zone 210.

The removable bonnet 16 supports electrical heating elements, which are not shown, and which are used, in a conventional manner, to maintain the molten metal in its molten state. As mentioned hereinabove, the heating elements may be controlled by a relay, in a variation of the circuit of FIG. 4.

A beam 300, which is not shown in FIG. 1, extends across the inner vessel 14, so as to support the lower edge of the end wall 154 of the removable bonnet 16, and is fitted at its opposite ends into suitable notches 312, 314, which are formed in the side walls 86, 88, of the inner vessel 14. The beam 300, which is made of the same material used for the inner vessel 14, is vacuum-formed so as to have a slot 320 opening downwardly and extending along the beam 300. The slot 320 receives an upper portion of a partition 330, which also is not shown in FIG. 1, and which extends downwardly into the molten metal deeply but so as to leave sufficient clearance for the molten metal to flow readily beneath the partition 330. The upper portion of the partition 330 is held securely in the slot 320 of the beam 300 by a plurality of tubular cross-pieces 332, which pass through suitable apertures 334 in the partition 330. The beam 300 is vacuum-formed so as to have suitable pockets 336 holding opposite ends 338 of the cross-pieces 332. Preferably, the cross-pieces 332 are made of tubular expanded metal, which tends to become interlocked with the vacuum-formed material of the beam 300.

The partition 330 divides the molten metal essentially into a major portion, which is covered by the removable bonnet 16 so as to minimize heat losses due to surface radiation, and so as to prevent influx of outside air containing free oxygen, and which is heated by the heating elements, and a minor portion, which reposes beneath the filling and emptying zone 210. As compared to the beam 300, which is made of a ceramic fiber that is a poor conductor of heat, the partition 330 is made of a different material that is a good conductor of heat, so as not to allow the molten metal beneath the uncovered zone 210 to cool excessively. Silicon carbide is a suitable material for the partition 330.

We claim:

1. In a furnace, which is adapted to hold molten zinc, molten aluminum, or other molten metal, a combination comprising:

(a) an outer vessel, which has lateral and bottom walls, (b) a removable, seamless, vacuum-formed, ceramic-fiber, one-piece, inner vessel, which is adapted to contain the molten metal, which has lateral and bottom walls, and which is fitted into the outer vessel so as to leave sufficient clearance around the inner vessel, between the lateral walls of the inner and outer vessels, for particulate matter to be packed around the inner vessel, between the lateral walls of the inner and outer vessels, and (c) a mass of unbonded particulate matter, which is packed around the inner vessel, between the lateral walls of the inner and outer vessels, so as to lodge the inner vessel laterally within the outer vessel despite nonconformities between the lateral walls of the inner and outer vessels, and so as to enable the inner vessel to be lifted readily from the outer vessel, (d) a layer of said matter, which is packed on the bottom walls of the outer vessel, between the bottom walls of the inner and outer vessels, so as to support the inner vessel and its contents firmly despite nonconformities between the bottom walls of the inner and outer vessels, and (e) an electrical circuit including electrical conductors, which are imbedded within the layer of said matter on the bottom wall of the outer vessel, said matter being packed so as to be previous to the molten metal, the electrical circuit not being attached to the inner vessel, the electrical circuit being open in normal operation of the furnace, the conductors being arranged to close the electrical circuit if any of the molten metal leaks from the inner vessel, perfuses said matter, and bridges the conductors, the electrical circuit including a signalling means, which is arranged to emit a signal if the electrical circuit is closed.

2. The combination of claim 1 wherein said matter is vermiculite.

3. The combination of claim 1 wherein said matter is sand.

4. The combination of claim 1 wherein the inner and outer vessels are made of insulative materials that are poor conductors of heat, and also comprising:

(f) a removable bonnet, which covers the inner and outer vessels except for an uncovered zone, and which is made of an insulative material that is a poor conductor of heat, (g) a beam, which is mounted across the inner vessel, and which is made of an insulative material that is a poor conductor of heat, and (h) a partition, which is mounted to and beneath the beam so as to extend into the molten metal deeply but so as to permit the molten metal to flow freely beneath the partition, and which is made of a material that is a good conductor of heat.

5. The combination of claim 4 wherein the removable bonnet, the inner vessel, and the beam are made of the same material.

* * * * *